United States Patent [19]

Rapisarda

[11] Patent Number: 4,722,035

[45] Date of Patent: Jan. 26, 1988

[54] DRUMSTICK WITH LIGHT EMITTING DIODE

[76] Inventor: Carmen C. Rapisarda, 1715 Edgecomb, Covina, Calif. 91724

[21] Appl. No.: 864,540

[22] Filed: May 19, 1986

[51] Int. Cl.[4] ..... F21V 33/00

[52] U.S. Cl. ..... 362/109; 362/119; 84/477 B; 84/422 S

[58] Field of Search ..... 362/102, 800, 118, 196, 362/206, 119, 120, 204, 109; 84/422 S, 477 B

[56] References Cited

U.S. PATENT DOCUMENTS

| | | | |
|---|---|---|---|
| 2,242,981 | 5/1941 | Pederson | 84/477 B |
| 2,651,710 | 9/1953 | Clark | 362/196 |
| 2,681,979 | 6/1954 | Manoloff | 84/477 B |
| 3,384,741 | 5/1968 | Bice | 84/477 B |
| 4,226,163 | 10/1980 | Welcomer | 84/422 S |
| 4,246,826 | 1/1981 | Warrick et al. | 84/422 S |
| 4,484,253 | 11/1984 | Roberts | 362/204 |

FOREIGN PATENT DOCUMENTS

| | | | |
|---|---|---|---|
| 378822 | 8/1932 | United Kingdom | 362/119 |

*Primary Examiner*—William A. Cuchlinski, Jr.
*Assistant Examiner*—D. M. Cox
*Attorney, Agent, or Firm*—Edgar W. Averill, Jr.

[57] ABSTRACT

An improved illuminated drumstick of the type having a light-emitting diode powered by batteries. The improvements include a switch using a flexible metal strap over a resilient pad affixed to one end of the batteries. Additionally, the batteries may be connected by a thin flexible strap, and the light emitting diode is rectangular in shape and securely held in a channel at the tip of the drumstick.

7 Claims, 7 Drawing Figures

DRUMSTICK WITH LIGHT EMITTING DIODE

BACKGROUND OF THE INVENTION

On Feb. 22, 1983, applicant filed a U.S. patent application, Ser. No. 468,131, on a lighted drumstick. Subsequent to the filing of this application, applicant learned of the existence of U.S. Pat. No. 4,226,163 entitled "Illuminated Drumsticks" and, thus, abandoned his earlier application.

Because drumsticks are subjected to intense impact and vibration, the switch design, diode support and battery connection methods are all subjected to substantial stress. In the design shown in applicant's abandoned application, the switch tended to flicker on and off after extended use. Furthermore, occasionally the connection between batteries would break and the conductors at the diode occasionally shorted out.

There is, thus, a need for an improved, more durable illuminated drumstick.

BRIEF SUMMARY OF THE INVENTION

The present invention is for an improved illuminated drumstick of the type having a light emitting diode, having two terminals in the tip thereof and one or more batteries held in the shaft thereof. A pair of conductors is connected to the light emitting diode and leads back to the batteries through a switch, and the light emitting diode is covered with a transparent tip. The improvement comprises switch means comprising a longitudinally movable, electrically conductive shaft in contact with a conductor leading to one terminal of the light emitting diode. A flexible conductive strap is affixed to one end of one of the batteries and extends over the end, and a resilient pad is positioned between the end of the battery and the conductive strip. Additionally, when there are a plurality of batteries, they may be connected by a flexible conductive strap welded, or otherwise electrically connected, to the casing of one battery and wrapped around the collector pin of the adjacent battery and electrically connected thereto. Lastly, the light emitting diode is preferably a rectangular diode held in a generally rectangular channel. The channel is formed by routing a channel in two halves of the drumstick, and after assembling the batteries and diode in one of the two halves, the two halves are glued and clamped together.

DESCRIPTION OF THE PREFERRED EMBODIMENTS

Figures 1, 2, 3, 4, 5, 6, 7:
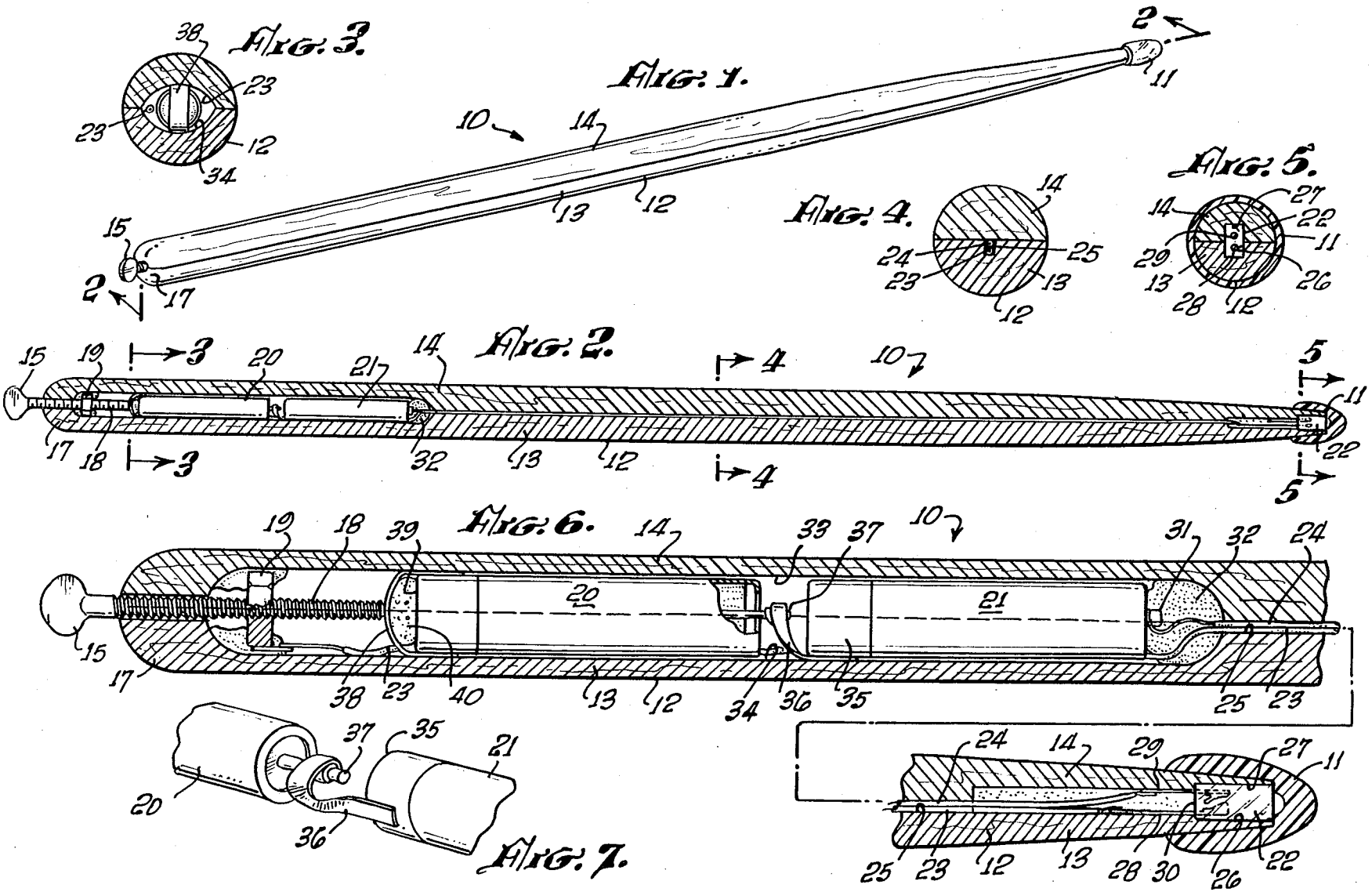
FIG. 1 is a perspective view of the illuminated drumstick of the present invention.
FIG. 2 is a cross-sectional view taken along line 2—2 of FIG. 1.
FIG. 3 is an enlarged cross-sectional view taken along line 3—3 of FIG. 2.
FIG. 4 is an enlarged cross-sectional view taken along line 4—4 of FIG. 2.
FIG. 5 is an enlarged cross-sectional view taken along line 5—5 of FIG. 2.
FIG. 6 is an enlarged cross-sectional view showing the tip and the battery compartment of the illuminated drumstick of FIG. 1.
FIG. 7 is an enlarged fragmentary, perspective view showing the connection of the batteries of the illuminated drumstick of FIG. 1.

The illuminated drumstick of the present invention is shown in perspective view in FIG. 1 and indicated generally by reference character 10. Drumstick 10 has a transparent tip 11 and a wooden shaft 12. Shaft 12 is made from two separate pieces which are laminated together, namely a lower half 13 and an upper half 14. A switch tab 15 extends outwardly from the handle end 17.

In use, the turning of switch tab 15 completes an electrical circuit and illuminates a light emitting diode held within transparent tip 11 in a manner described in detail below. The illuminated drumstick greatly enhances the visual effect of a drummer during a performance. When the performance is over, the switch tab 15 is turned to disconnect the batteries and prolong their life.

The inner construction of drumstick 10 is shown in cross-sectional view in FIG. 2 where it can be seen that switch tab 15 is integral with a longitudinally movable, electrically conductive shaft 18 which comprises a threaded shaft held by a nut 19 shown in further detail in FIG. 6. Shaft 18 makes electrical contact with the casing of the rearward battery 20 which, in turn, is electrically connected to forward battery 21.

Batteries 20 and 21 provide electrical energy to a light emitting diode assembly 22 held at the tip of drumstick 10. A pair of insulated conductors 23 and 24 are held in a narrow groove 25 formed at the surface of lower half 13 prior to its being joined with upper half 14. Groove 25 is about the same width as one of the conductors so that one conductor is held directly above and adjacent to the second conductor without sufficient room to permit the conductors to move and thereby wear in the groove 25.

Light emitting diode assembly 22 is generally rectangular in shape as shown in FIGS. 2, 5 and 6. As is evident from a consideration of the use of the drumsticks, the tip of the drumstick is subjected to intense vibration and shock and many unsatisfactory diode supporting methods were rejected before adoption of the present system. Diode assembly 22 fits tightly in a pair of grooves 26 and 27 formed in upper half 14 and lower half 13, respectively. Diode assembly 22 is held in grooves 26 and 27 by an adhesive, and the electrical leads 28 and 29 of diode assembly 22 are cut to different lengths as shown in FIG. 6 to reduce the possibility of an electrical short between the leads. The transparent tip 11 is made from an impact resistant, transparent polymer such as a polycarbonate polymer and extends not only over the tip but also past the base 30 of diode assembly 22. Tip 11 also extends over the exterior of the tip of drumstick 10. In this way, the tip, diode and drumstick are joined together to form a unitary, strong structure capable of withstanding the shock to which it is submitted.

Another former point of weakness is the connection of battery 20 to battery 21 which is shown best in FIG. 6. Initially, it should be noted that the anode collector 31 of battery 21 is soldered, welded or otherwise affixed to conductor 24 and a quantity of hot melt adhesive 32 is placed around this connection to help prevent any disconnection thereof. It can readily be seen that batteries 20 and 21 and the base of the switch are contained in a pair of cavities 33 and 34 in upper half 14 and lower half 13, respectively. As shown best in FIG. 7, the cathode end or base 35 of battery 21 has a flexible metallic strap 36 welded along the side adjacent thereto. Flexible metallic strap 36 should be made from a material capable of withstanding vibration, readily weldable and thin enough to permit the ready bending thereof. It has been found that nickle plated steel having a thickness of about 0.005 inches has proved very satisfactory. Strap 36 is wrapped around and soldered or welded to the annode collector pin 37 of battery 20. Of course, batteries 20 and 21 are also secured to cavities 33 and 34 by an adhesive such as poly vinyl acetate glue.

The switch mechanism of the illuminated drumstick of the present invention provides an important improvement which has eliminated many of the problems present in the original design. The construction of the switch is shown best in FIG. 6 where it can be seen that conductor 23 is electrically connected to nut 19 which, in turn, forms an electrical contact with shaft 18 which is threaded therethrough. A flexible conductive strap 38 is welded near the cathode end 39 of battery 20. Strap 38 is welded along both sides of cathode end 39 and a resilient pad 40 is placed between flexible strap 38 and the cathode end 39 of battery 20. This resilient pad performs several functions. Firstly, it protects the cathode end 39 from damage by contact with shaft 18. Secondly, when shaft 18 has been screwed down against flexible strap 38, the pad pushes outwardly against the shaft and tends to hold it tightly against the threads in nut 19, thus helping to prevent it from inadvertently unscrewing during use. Lastly, pad 40, as it is further compressed, exerts increasing force against shaft 18 making it easy to feel when the tab 15 has been turned sufficiently. Strap 38, as well as the cavities 33 and 34 are shown in end and cross-sectional view in FIG. 3. Preferably, strap 38 is fabricated from stainless steel of about 0.01 inches thick. FIG. 3 also shows an additional battery support and wire protection feature of the present assembly where it can be seen that cavities 33 and 34 do not form a circle but instead are elongated as shown in FIG. 3 which permits space along the side for conductors 23 and 24 which are not then rubbed by the batteries.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved illuminated drumstick of the type having a light emitting diode having two terminals in the tip thereof, one or more batteries held in the shaft thereof, each of said batteries having a cathode and an anode collector and a first end and a second end, a pair of conductors connected between the light emitting diode and the batteries, a switch and a transparent tip, wherein the improvement comprises:

switch means comprising a longitudinally movable, electrically conductive shaft in contact with a conductor leading to one terminal of said light emitting diode;

a flexible, conductive strap affixed to the cathode collector of one of said one or more batteries and extending over the second end thereof;

a resilient pad positioned between said conductive strap and the second end of said battery, whereby when said longitudinally movable, electrically conductive shaft is moved inwardly to contact said conductive strap, said conductive strap is deformed inwardly while being urged outwardly by the deformation of said resilient pad thereby maintaining a continuous contact in spite of the impact caused by the use of said drumstick.

2. The improved illuminated drumstick of claim 1 wherein said electrically conductive shaft is threaded and moved longitudinally by turning the shaft.

3. The improved illuminated drumstick of claim 1 wherein said resilient pad is an elastomeric pad and said conductive strap is a stainless steel strip.

4. The improved illuminated drumstick of claim 3 wherein said strap is about 0.01 inches thick.

5. An improved illuminated drumstick of the type having a light emitting diode having two terminals in the tip thereof, one or more batteries held in the shaft thereof, each of said batteries having a cathode and an anode collector and a first end and a second end, a pair of conductors connected between the light emitting diode and the batteries, a switch and a transparent tip wherein the improvement comprises:

a connected pair of batteries, the forward battery having a conductor of said light emitting diode electrically connected to the anode collector thereof, and the cathode collector thereof having a conductive strap affixed in electrical contact therewith along the side thereof and said strap being wrapped around and electrically connected to the anode collector pin of the rearward battery.

6. The improved illuminated drumstick of claim 5 wherein said conductive strap is about 0.01 inches thick.

7. An improved illuminated drumstick of the type having a light emitting diode having two terminals in the tip thereof, one or more batteries held in the shaft thereof, each of said batteries having a cathode and an anode collector and a first end and a second end, a pair of conductors connected between the light emitting diode and the batteries, a switch and a transparent tip, said drumstick having a shaft which is formed from two generally rectangular sticks which are joined to form a unitary piece wherein the improvement comprises:

a light emitting diode body in the shape of a rectangular solid, said diode body being held in a generally rectangular opening formed in the inner surface of each of said two generally rectangular sticks prior to the joining of said sticks and wherein the outer end of said light emitting diode is about co-terminus with the end of the two generally rectangular sticks and wherein the transparent tip of said drumstick extends in the direction of the center of the drumstick beyond the inner end of the light emitting diode and over the exterior of the drumstick.

* * * * *